US005970283A

United States Patent [19]

Obermayer

[11] Patent Number: 5,970,283

[45] Date of Patent: Oct. 19, 1999

[54] DEVELOPER STATION FOR ELECTROPHOTOGRAPHIC PRINTER AND COPIER DEVICES

[75] Inventor: Heinz Obermayer, Grafrath, Germany

[73] Assignee: Océ Printing Systems GmbH, Poing, Germany

[21] Appl. No.: 08/955,966

[22] Filed: Oct. 22, 1997

[30] Foreign Application Priority Data

Oct. 22, 1996 [DE] Germany ..... 196 43 634

[51] Int. Cl.[6] ..... G03G 15/04

[52] U.S. Cl. ..... 399/119; 399/267

[58] Field of Search ..... 399/98, 99, 119, 399/222, 254, 263, 265, 267, 276, 277

[56] References Cited

U.S. PATENT DOCUMENTS

| | | | |
|---|---|---|---|
| 4,714,046 | 12/1987 | Steele et al. | 399/276 X |
| 4,797,704 | 1/1989 | Williams et al. | 399/119 |
| 4,878,089 | 10/1989 | Guslits et al. . | |
| 5,028,959 | 7/1991 | Gooray | 399/98 X |
| 5,080,038 | 1/1992 | Rubin . | |
| 5,083,166 | 1/1992 | Hill et al. | 399/119 |
| 5,095,340 | 3/1992 | Mahoney | 399/254 X |
| 5,181,075 | 1/1993 | Rubin . | |
| 5,227,848 | 7/1993 | Robinson et al. | 399/277 X |
| 5,400,124 | 3/1995 | Kass et al. | 399/276 |
| 5,606,404 | 2/1997 | Hilbert et al. | 399/267 |

*Primary Examiner*—Sandra Brase
*Attorney, Agent, or Firm*—Hill & Simpson

[57] ABSTRACT

A developer station is provided for electrophotographic printer and copier devices, including a developer conveyor means (3) and a developer deflection housing. The developer deflection housing, on whose outside surface developer material is conveyed, has a developer transfer area (2*a*), at which developer (7) conveyed in by the conveyor means (3) is applied onto the developer deflection housing, and a toner transfer area (2*b*), which transfers toner to a photoconductor, applied on its surface, the toner transfer area (2*b*) proceedings complementary to the surface of the photoconductor (4). Further, a magnet rotor (1) is arranged such in the deflection housing that the spacing thereof from the surface of the deflection housing decreases at least up to the toner transfer area (2*b*) proceeding from the developer transfer area (2*a*).

19 Claims, 3 Drawing Sheets

DEVELOPER STATION FOR ELECTROPHOTOGRAPHIC PRINTER AND COPIER DEVICES

BACKGROUND OF THE INVENTION

1. Field of the Invention

The present invention is directed to a developer station for electrophotographic printer and copier devices.

2. Description of the Related Art

In electrophotographic printer and copier devices, a latent charge image is generated by charge differences on a photoconductor such as, for example, a photoconductor of a photoconductive drum. Depending on the method used in the printer or copier, the toner is applied to either the charged or the discharged regions of the photoconductor, this toner being subsequently transferred onto a recording medium such as, for example, a sheet of paper and is then fixed thereon.

In order to be able to apply toner onto a photoconductor, a developer mixture that, for example, is composed of two components, toner and carrier material, is offered in a developer station. In the developer station, the toner is charged by being mixed with the carrier material, which is for example iron oxide, and is applied onto one or more developer drums that usually comprise a rotating magnet rotor in a rotating sleeve. As a result of the magnetic field that is generated by the rotating magnets, what are referred to as toner brushes are formed on the sleeve of the developer drum, these toner brushes being aligned according to the magnetic field.

Due to the rotation of the sleeve of the developer drum, the toner brushes are transported to the photoconductor and are transferred either onto the charged or the discharged regions depending on the method being employed.

U.S. Pat. No. 4,878,089 discloses a developer station in which a two-component developer composed of toner and toner carrier is transferred onto a photoconductor. To this end, a hollow, cylindrical deflection housing having a circular cross section is provided close to the photoconductor, a developer transfer region, at which the developer material is applied onto the deflection housing by a conveyor means, and a toner transfer region, at which the toner is transferred onto the photoconductor, being formed on the surface of this deflection housing. A magnet rotor is eccentrically arranged in the deflection housing such that the spacing of the magnet rotor from the outside surface of the deflection housing decreases toward the toner transfer region proceeding from the developer transfer region. The rotating magnet rotor generates a migrating magnetic field at the surface of the deflection housing, the developer on the surface of the developer transfer region being conveyed to the toner transfer region by this migrating magnetic field. The uniform minimization in the spacing of the magnet rotor thereby effects a continuous increase in the magnetic forces toward the toner transfer region proceeding from the developer transfer region, as a result whereof the developer forms uniformly thick toner brushes in the toner transfer region.

In the known developer station, it is especially disadvantageous that a toner transfer from the deflection housing onto the photoconductor can be non-uniform since the transfer of the toner from the deflection housing to the photoconductor ensues only in a narrow, line-like transfer region. Further, the space required for the above-described developer station is relatively great.

For transferring developer (toner) onto a photoconductor, U.S. Pat. Nos. 5,080,038 and 5,181,075 provide a stationary, non-magnetic housing in which a magnet rotor likewise rotates. As a result of the rotating magnet rotor, an alternating magnetic field with which, above all else, toner is conveyed along the stationary, non-magnetic housing is generated. The part of the stationary housing that lies opposite the photoconductor such as, for example, a photoconductive drum which is fashioned complementary thereto.

Despite the described fashioning of the stationary housing, the embodiments disclosed in the two United States patents have the disadvantage that the magnetic field is weaker at the two edges of the toner transfer region from the stationary housing to the photoconductive drum since the distance between rotating magnet rotor and stationary housing is larger at the region edges.

In order to avoid the above-described disadvantage, magnetizable spaces (see U.S. Pat. No. 5,181,075) and weak permanent magnets additionally referred to as transport-supporting magnets (see U.S. Pat. No. 5,080,038) are provided in the edge regions (referred to as shoulders) of the toner transfer region in which the magnetic field is weaker. The field lines are intensified by these two magnets but this also leads to increased eddy current losses. Higher eddy currents are likewise to be expected since the magnet rotor is not eccentrically arranged, this resulting a heating of the housing and leading to an adhesion of toner to the housing. Further, the magnetic field is non-uniformly formed on the surface of the housing.

SUMMARY OF THE INVENTION

It is therefore an object of the invention to provide a developer station for electrophotographic printer and copier devices with which toner is uniformly transferred onto a photoconductor in a highly reliable fashion.

This and other objects and advantages are inventively achieved by a developer station for an electrophotographic printer and copier device having a developer conveyor device, a developer deflection housing on whose exterior surface a developer material is conveyed, the developer deflection housing having a developer transfer area to which the developer is conveyed by the developer conveyor device and a toner transfer area from which developer is transferred to a photoconductor, the toner transfer area being positioned complementary to the surface of the photoconductor; and a magnet rotor that is arranged in the deflection housing such that the distance of the rotor from the surface of the deflection housing decreases at least up to the toner transfer area proceeding from the developer transfer area.

Advantageous developments are provided by a developer return area of the developer station wherein the distance following the toner transfer area increases up to the developer return area in which the developer is delivered from the developer deflection housing into a developer mixing space. That end of the developer deflection housing facing toward the developer mixing space preferably ends in an acutely tapering section. The acutely tapering section may be of an anti-static material.

In a preferred embodiment, a variable bias voltage is applied to the developer deflection housing, which is of conductive material. Another feature is that a stripper ledge is attached to a housing of the developer station between the developer transfer area and the toner transfer area.

A further advantageous feature of the invention provides that the magnet rotor is seated displaceable perpendicular to its rotational axis in the direction toward the conveyor means and away therefrom. The magnet rotor preferably comprises a plurality of magnets along its circumference whose N poles are respectively adjacent to the S pole of the neighboring magnets and vice versa. Interspaces between the magnets are filled with fiberglass-reinforced plastic.

In operation, the magnet rotor conveys the developer opposite its rotational sense, conveying the developer from the developer transfer area in the direction toward the toner transfer area. The speed of the magnet rotor lies in the range from about 1000 to 4000 rpm.

The preferred conveyor device is a mixing and conveying apparatus that has a plurality of paddles with an L-shaped cross section, whereby an inner paddle part of each paddle is radially aligned with respect to a shaft of the mixing and conveying apparatus, an outer paddle part projects perpendicularly from the inner paddle part in rotational sense, and the inner paddle part comprises recesses and deflection plates. The deflection plates project from the inner paddle part at an acute angle. The deflection plates provided at a paddle are aligned parallel to one another. The deflection plates projecting from two neighboring paddles may point in opposite directions so that the developer is conveyed in opposite directions by two neighboring paddles of the mixing and conveying means. The inner paddle part of each paddle has a projection proceeding parallel to the inner paddle part in a radial direction outside the outer paddle part. Developer repellers are preferably provided in the region of both ends of the shaft of the mixing and conveying means.

As an additional feature, an extraction channel is fashioned in the housing of the developer station following the toner transfer area in the developer conveying direction.

In the invention, the surface of the housing is fashioned to be complementary to the photoconductor in the region of the toner transfer area, i.e. it proceeds at a uniform distance from the surface of the photoconductor in the toner transfer area. As a result of this fashioning of the toner transfer area, the toner is transferred onto the photoconductor along a broad surface section of the deflection housing that corresponds to the surface of the toner transfer area, as a result whereof a complete toner transfer onto the photoconductor is assured. Due to the decreasing distance of the magnet rotor from the surface of the deflection housing toward the toner transfer area proceeding from the developer transfer area, the stray flux of the magnetic field is increased at the same time, so that the developer—which is in the form of toner brushes—is uniformly transported through the toner transfer area. As a result of the inventive fashioning of the deflection housing in combination with the simultaneously asymmetrical arrangement of the magnet rotor, a combined effect arises on the basis whereof the developer—that is homogenized or made uniform in the form of toner brushes—is conveyed through the complementary toner transfer area, so that the toner is uniformly transferred onto the photoconductor.

In an advantageous development of the anti-magnetic deflection housing, the spacing between the magnet rotor and the deflection housing becomes greater in the conveying direction of the residual toner and of the carrier beginning with the toner transfer area at least up to a carrier return area. As a result thereof, the magnetic field advantageously becomes weaker in this transport section and residual toner as well as carrier material are returned into a mixing region of the developer station.

In order to preclude a transport of toner and carrier from the toner return area to the developer transfer area along the deflection housing, an acutely tapering projection is provided at an end facing toward the developer mixing space. As a result thereof, the distance from the magnet rotor is increased again and the effective magnetic field is therefore even weaker, so that toner and/or carrier cannot remain adhering to the acutely tapering projection.

It is also proposed that a stripper ledge be provided in the developer station following the developer transfer area as viewed in the developer conveying direction, so that he developer is applied on the deflection housing in a uniform thickness.

For varying the amount of developer and, thus, of toner at the toner transfer point, the magnet rotor is displaceable, for example on a slideway. As a result thereof, the distance between the magnet rotor and deflection housing and, thus, the magnetic field acting on the developer can be adjusted, particularly in the section from the developer transfer area up to the toner transfer area. Further, a bias voltage is applied to the deflection housing composed of conductive material in order to thereby additionally vary the amount of developer transported on the deflection housing.

The magnet rotor comprises a plurality of magnets along its circumference, these being arranged such that the S pole of a neighboring magnet lies next to every N pole of a magnet. For stiffening the magnet rotor and in order to absorb the high centrifugal forces, the interspaces between the individual magnets are filled with fiberglass-reinforced plastic.

In order to be able to vary the amount of toner to be transported on the deflection housing and, thus, the amount of toner to be transferred to the photoconductor, the speed of the magnet rotors, whose rotational sense is opposite the direction of the movement of the developer on the deflection housing, is adjustable in a speed range from about 1000 to 4000 rpm. For minimizing the eddy current losses, the deflection housing is fabricated of a material having a high specific resistance that is composed of 30% Ni, 20% Cr and 50% Fe and that is also anti-magnetic.

In a preferred improvement of the developer station, the conveyor means is inventively fashioned such as a mixing and conveying means that both a mixing as well as a conveying is implemented with a single device. As a result thereof, the space required by the inventive developer station is substantially smaller compared to known developer stations.

The mixing and conveying means comprises a plurality of paddles with an L-shaped cross section that are arranged along the shaft such that an inner paddle part is radially arranged with respect to the shaft and is secured thereto, whereas the outer paddle part of each paddle extends from the inner paddle part in the rotational sense of the shaft. A thorough circulation of the developer is already assured on the basis of this fashioning of the plurality of paddles.

Further, it is proposed that the inner paddle parts have additional recesses and deflection plates, whereby the latter are arranged at that side of the inner paddle part facing away from the rotational sense of the shaft and describe an acute angle therewith. The deflection plates are preferably respectively connected to a recess that is provided in the inner paddle part.

Due to the rotational motion of the mixing and conveying means, thus, developer is partly circulated by the paddles; developer partly passes through the recesses and, dependent on the arrangement of the deflection plates, is transported, for example parallel to the shaft axis, by the deflection plates.

For intensifying the transverse conveying, all deflection plates of a paddle are arranged parallel to one another. In order to achieve an optimally homogeneous developer mixture, the deflection plates of two neighboring paddles are respectively arranged in opposite directions, so that the developer is moved in opposite directions, for example parallel to the shaft axis, by two neighboring paddles when the mixing and conveying device rotates.

For conveying the developer, each paddle of the mixing and conveying means can have a projection in the outer region of the paddle, this projection being preferably radially directed. As a result thereof, developer is picked up between the projection and outer paddle part, which extends in a rotational sense proceeding from the inner paddle part, and is conveyed in the direction of the developer transfer area.

In order to avoid a contamination of the bearing as well as leakage of developer from the developer station as a result of the developer transported in the direction of the shaft ends of the mixing and conveying means with the deflection plates, developer repellers are additionally provided that reverse the conveying direction of the developer, so that damage to the bearings due to contamination and an emergence of the developer are precluded.

According to yet another advantageous development of the invention, further, an extraction channel is provided following the toner transfer area as viewed in the developer conveying direction, an underpressure being connected to the extraction channel in order to extract excess toner but particularly toner dust and potentially conduct it back into the developer station. As a result thereof, visible errors on recording media which show up, for example as black dots, are advantageously avoided given excessively great toner quantities on the photoconductor.

BRIEF DESCRIPTION OF THE DRAWINGS

The invention is explained in greater detail below on the basis of a preferred embodiment with reference to the enclosed drawings.

DETAILED DESCRIPTION OF THE PREFERRED EMBODIMENTS

Figure 1:
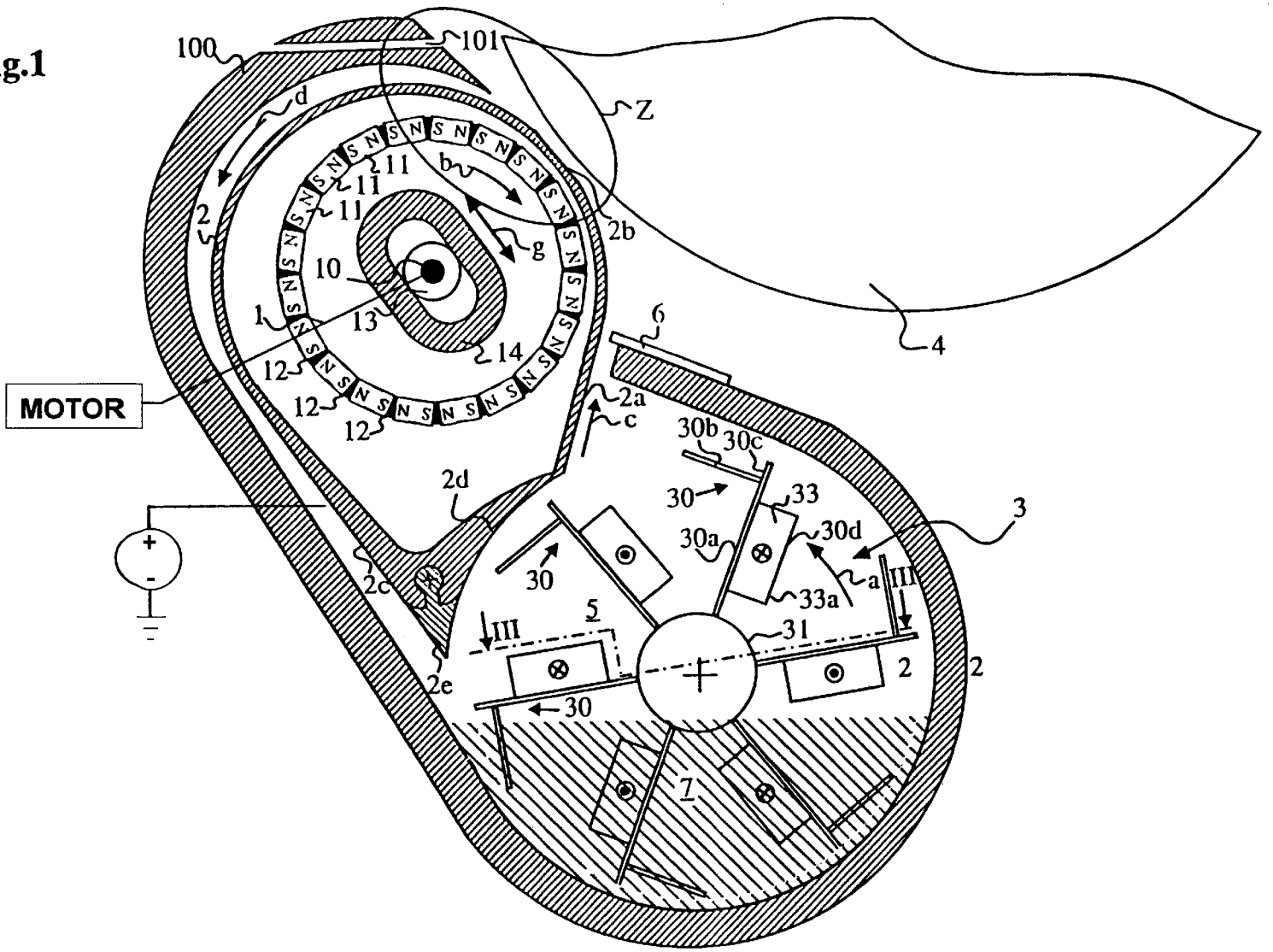
FIG. 1 is a side sectional view of a preferred embodiment of the inventive developer station.

FIG. 1 shows a schematic sectional view of a preferred embodiment of an inventive developer station, a mixing and conveying means 3 and a stationary deflection housing 2 being accommodated in the housing 100 thereof. A magnet rotor 1 is driven in the deflection housing 2 via a drive shaft 10.

With the exception of a toner transfer area 2*b* described in greater detail with reference to FIG. 2, the area of the deflection housing 2 shown at the top left in FIG. 1 is fashioned as part of a generated cylinder surface. At about the level of a stripper ledge 6 attached to the housing 100, the generated cylinder surface merges tangentially into a planar developer transfer area 2*a*. At its other end, the generated cylinder surface likewise merges tangentially into a toner return area 2*c*. The two areas 2*a* and 2*c* are connected to one another via a curved region 2*d* whose radius of curvature at the outside at least corresponds to the radius of the mixing and conveying means 3. Further, the transition between the two areas 2*c* and 2*d* of the deflection housing 2 is fashioned in the form of a tip 2*e* that is preferably composed of anti-static material.

The magnet rotor 2 provided in the deflection housing 2 comprises magnets 11 along its circumference whose N poles are respectively adjacent to a S pole of a neighboring magnet 11 and vice versa. Interspaces 12 between the magnets 11 are preferably filled with fiberglass-reinforced plastic 12, so that an extremely stiff rotor is created as a result thereof.

The magnet rotor 1, which is driven via the drive shaft 10, is displaceable via an adapter part 13 in a slideway 14, being displaceable perpendicular to the rotational axis 10 in the direction of an arrow g. For example, the distance between the developer transfer area 2*a* of the deflection housing 2 and the magnet rotor 1 can be easily set by displacing the magnet rotor 1 in the direction of the arrow g.

The mixing and conveying means 3, whose mixing function shall be explained in greater detail later with reference to FIG. 3, comprises paddles 30 with an L-shaped cross section whose inner paddle parts 30*a* are secured to a shaft 31. In the sectional view in FIG. 1, outer paddle parts 30*b* extend, for example, perpendicular to the inner paddle parts 30*a* in the rotational sense of the mixing and conveying means 3 indicated by the arrow a.

For conveying toner, the paddles 30 comprise projections 30*c* at the outer end of the inner paddle parts 30*a*, these being preferably arranged parallel and outside the outer paddle parts 30*b* in a radial direction or, as can be seen from FIG. 1, as an extension of the outer paddle parts 30*b*. By turning the mixing and conveying means 3 in the direction of the arrow a, developer material 7—which is accommodated in the lower part of the housing 100 of the developer station is picked up by the projections 30*c* in the direction of the developer transfer area 2*a* of the deflection housing 2 both due to centrifugal force as well as due to the magnetic attraction of the magnet rotor 1.

An alternating magnetic field arises due to the rotation of the magnet rotor 1 in the direction of the arrow b. The developer that is transported to the developer transfer area 2*a* by the mixing and conveying means 3 aligns itself along the magnetic field lines, as a result whereof what are referred to as toner brushes are formed. Due to the alternating magnetic field caused by the rotation of the magnet rotor 1, the carrier with the toner moves on the deflection housing 2 in the direction of the arrow c up to the toner transfer area 2*b*.

Figure 2:
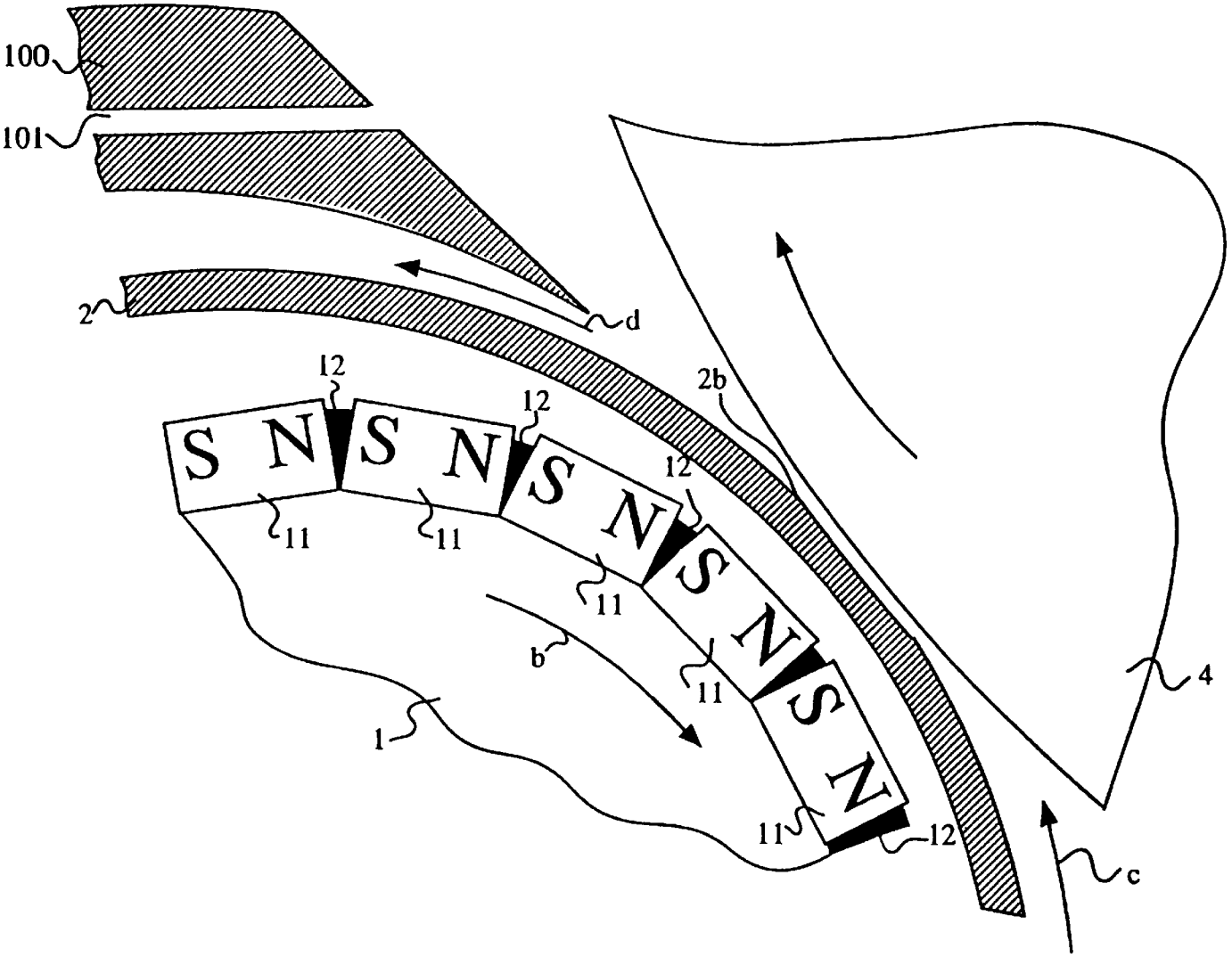
FIG. 2 is an enlargement of the area referenced Z in FIG. 1.

FIG. 2 shows an enlargement of the region referenced Z in FIG. 1. As described above, the developer is transported on the deflection housing 2 in the direction of the arrow c. In order to enlarge the toner transfer area 2*b* between the deflection housing 2 and a photoconductive drum 4, the deflection housing 2 is shaped to be complementary to the photoconductive drum 4 in the toner transfer area 2*b*. The toner that is not transferred onto the photoconductive drum 4 as well as the carrier particles of the developer are further conveyed in the direction of an arrow d on the deflection housing 2 by the alternating magnetic field following the toner transfer area 2*b* that is generated with the magnet rotor 1.

The housing 100 of the developer station comprises a channel 101 charged with underpressure via which toner particles but particularly toner dust are suctioned off from the photoconductor 4 and conducted via a conduit (not shown in FIG. 2) such as, for example, a hose or a pipe into a collecting vessel (likewise not shown) or, potentially, are also returned into the developer station.

As can be seen from FIG. 1, the residual toner and the carrier particles are transported in the direction of the arrow d along the deflection housing 2 up to a toner return area 2*c*. Toner and carrier particles fall from the toner return area 2*c* back into a developer mixing space 5 since, on the one hand, the magnetic field generated by the magnet rotor 1 becomes weaker and weaker in the toner return area 2*c* due to the increasing spacing between the magnet rotor 1 and the deflection housing 2 in the conveying direction of the toner and carrier (arrow d), and the force of gravity due to the earth's attraction additionally acts on the toner and the carrier particles.

The preferably anti-static tip 2*e* between the two areas 2*c* and 2*d* prevents toner and/or carrier from being transported along the deflection housing 2 from the area 2*c* into the area 2*d*. It is thus assured that only developer that has been mixed by the mixing and conveying means 3 and which has a predetermined ratio of toner to carrier particles is transported to the developer transfer area 2*a*.

The structure of the mixing and conveying means 3 will be described in greater detail below with reference to FIG. 1 and FIG. 3, which shows a sectional view of the mixing and conveying means 3 along the line III—III in FIG. 1. The mixing and conveying means 3 preferably comprises an even-numbered plurality of paddles 30 that are uniformly arranged along the circumference of the shaft 31. Each paddle 30 comprises a plurality of deflection plates 33 that are arranged at the inner paddle part 30*a* of each paddle 30 on that side of an inner paddle part 30*a* facing away from the rotational direction a of the shaft 31.

Figure 3:
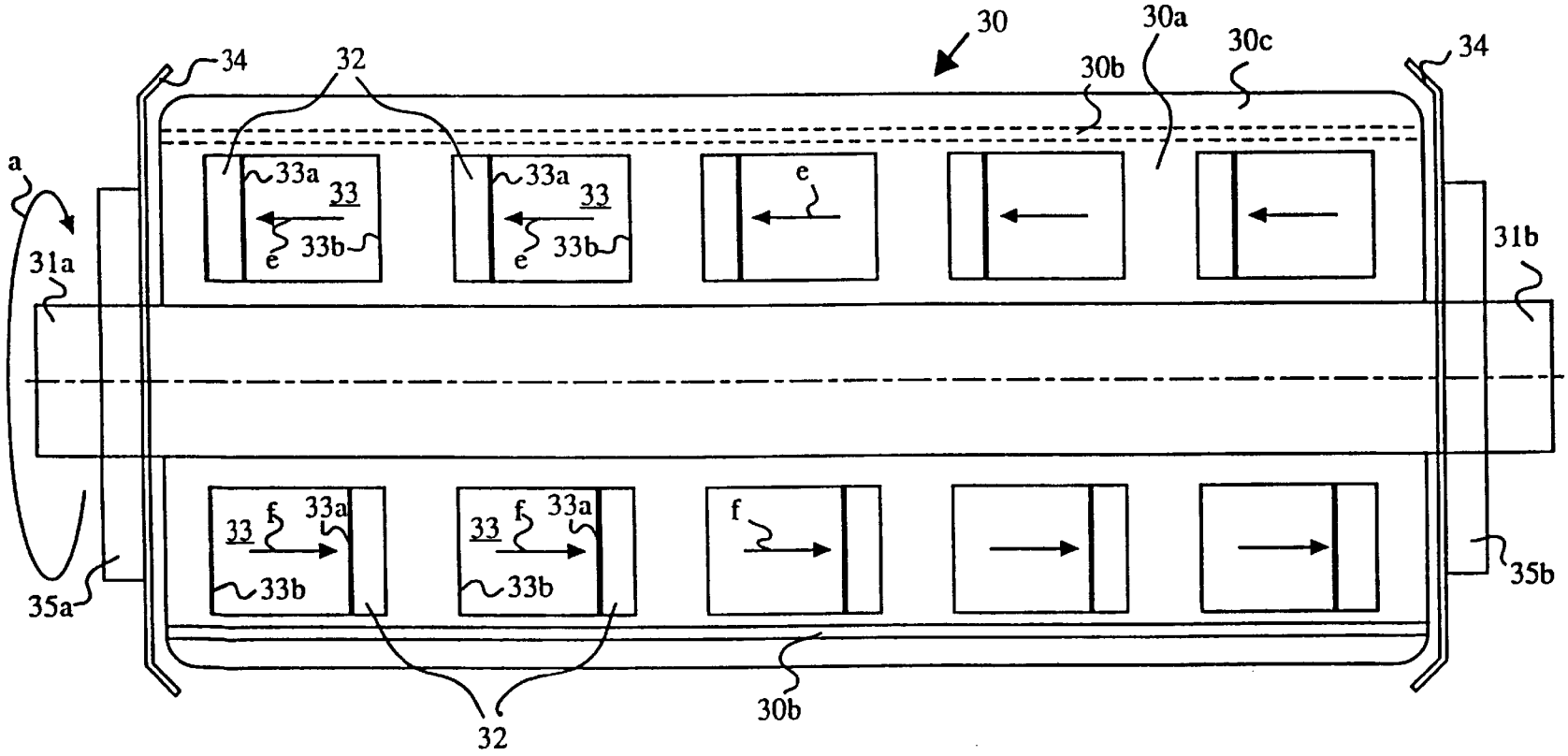
FIG. 3 is a sectional view along the line III—III in FIG. 1.

As can be seen from FIG. 3, each inner paddle part 30*a* comprises a plurality of recesses 32, five such recesses 32 being provided in the device shown in FIG. 3. The deflection plates 33 (FIG. 1) are connected to the inner paddle parts 30*a* at sides 33*b*. The end edges 33*a* of the deflection plates 33 that preferably are projecting from the inner paddle part 30*a* at an acute angle are emphasized with a thick stroke in FIG. 3.

In FIG. 3, the deflection plates 33 of the paddles 30 shown above the shaft 31 in FIG. 3 extend upward from the plane of the drawing at an acute angle, whereas the deflection plates 33 of the paddles 30 shown below the shaft in FIG. 3 project downward from the plane of the drawing, likewise at an acute angle. Given a rotation of the mixing and conveying means 3 in the direction of the arrow a, the toner passes through the recesses 32 and, for example, is transported in the direction of the arrows e by the deflection plates 33 of the paddles 30 shown above the shaft 31 in FIG. 3 and is transported in the direction of the arrows f by the deflection plates of the paddles which are shown below the shaft 31.

Given a rotation in the direction of the arrow a in the illustration of the mixing and conveying means 3 in FIG. 1, the deflection plates 33 either transport developer 7 into the plane of the drawing which is indicated by a circle with a cross—or out of the plane of the drawing—which is indicated by a circle with a dot. As can also thus be seen from FIG. 1, the developer 7 is conveyed in opposite directions by two neighboring paddles 30 and is thereby mixed.

It can also be seen from FIG. 3 that developer repellers 34 are provided at the mixing and conveying means 3 in the region of the shaft ends 31*a* and 31*b* of the shaft 31, so that developer that is transported in the direction toward the shaft bearings 35*a* or, respectively, 35*b* is kept away from the bearings 35*a* and 35*b* by the developer repellers 34.

Although other modifications and changes may be suggested by those skilled in the art, it is the intention of the inventors to embody within the patent warranted hereon all changes and modifications as reasonably and properly come within the scope of their contribution to the art.

We claim:

1. A developer station for an electrophotographic printer and copier device, comprising:

a developer conveyor device;

a developer deflection housing on whose exterior surface a developer material is conveyed and to whose surface is provided a developer transfer area at which the developer conveyed in by the developer conveyor device is applied onto the developer deflection housing;

a photoconductor;

a toner transfer area of a shape that is complementary to a surface of said photoconductor for transferring toner to said photoconductor; and a magnet rotor in the deflection housing, said magnetic rotor being arranged and said deflection housing shaped so that a distance of said magnet rotor from the surface of the deflection housing decreases proceeding from the developer transfer area at least up to the toner transfer area.

2. A developer station according to claim 1, wherein said deflection housing is shaped so that a distance from said magnet rotor following the toner transfer area increases up to a developer return area in which the developer is delivered from the developer deflection housing into a developer mixing space.

3. A developer station according to claim 2, further comprising:

an acutely tapering section at an end of the developer deflection housing facing toward the developer mixing space end.

4. A developer station according to claim 1, wherein said developer deflection housing is of a conductive material, and further comprising:

a voltage supply connected to provide a variable bias voltage to the developer deflection housing.

5. A developer station according to claim 1, further comprising:

a stripper ledge attached to the developer deflection housing between the developer transfer area and the toner transfer area.

6. A developer station according to claim 1, wherein the magnet rotor includes a plurality of magnets along its circumference whose N poles are respectively adjacent to S poles of neighboring magnets and vice versa.

7. A developer station according to claim 6, further comprising: fiberglass-reinforced plastic fill in interspaces between the plurality of magnets.

8. A developer station according to claim 1, wherein the magnet rotor is operable to convey the developer opposite its rotational sense, conveying said developer from the developer transfer area in a direction toward the toner transfer area.

9. A developer station according to claim 1, further comprising: a rotor drive to drive a speed of the magnet rotor in the range from about 1000 to 4000 rpm.

10. A developer station according to claim 1, wherein said developer deflection housing defines an extraction channel following the toner transfer area in the developer conveying direction.

11. A developer station as claimed in claim 1, wherein said photoconductor is a photoconductive drum and said toner transfer area of a shape that is complementary to said photoconductive drum.

12. A developer station for an electrophotographic printer and copier device, comprising:

a developer conveyor device:

a developer deflection housing on whose exterior surface a developer material is conveyed and to whose surface is provided a developer transfer area at which the developer conveyed in by the developer conveyor device is applied onto the developer deflection housing;

a photoconductor;

a toner transfer area of a shape that is complementary to a surface of said photoconductor for transferring toner to said photoconductor; and a magnet rotor in the deflection housing, said magnetic rotor being arranged and said deflection housing shaped so that a distance of said magnet rotor from the surface of the deflection housing decreases proceeding from the developer transfer area at least up to the toner transfer area, said deflection housing being shaped so that a distance from said magnet rotor following the toner transfer area increases up to a developer return area in which the developer is delivered from the developer deflection housing into a developer mixing space, an acutely tapering section at an end of the developer deflection housing facing toward the developer mixing space end, said the acutely tapering section being anti-static.

13. A developer station for an electrophotographic printer and copier device, comprising:

a developer conveyor device;

a developer deflection housing on whose exterior surface a developer material is conveyed and to whose surface is provided a developer transfer area at which the developer conveyed in by the developer conveyor device is applied onto the developer deflection housing;

a photoconductor;

a toner transfer area of a shape that is complementary to a surface of said photoconductor for transferring toner to said photoconductor;

a magnet rotor in the deflection housing, said magnetic rotor being arranged and said deflection housing shaped so that a distance of said magnet rotor from the surface of the deflection housing decreases proceeding from the developer transfer area at least up to the toner transfer area; and a perpendicularly displaceable mounting for the magnet rotor to displace the magnet rotor perpendicular its rotational axis in a direction alternately toward and away from the developer conveyor device.

14. A developer station for an electrophotographic printer and copier device, comprising:

a developer conveyor device;

a developer deflection housing on whose exterior surface a developer material is conveyed and to whose surface is provided a developer transfer area at which the developer conveyed in by the developer conveyor device is applied onto the developer deflection housing;

a photoconductor;

a toner transfer area of a shape that is complementary to a surface of said photoconductor for transferring toner to said photoconductor; and a magnet rotor in the deflection housing, said magnetic rotor being arranged and said deflection housing shaped so that a distance of said magnet rotor from the surface of the deflection housing decreases proceeding from the developer transfer area at least up to the toner transfer area;

the developer conveyor device being a mixing and conveying device that has a plurality of paddles with an L-shaped cross section, each of said paddles having an inner paddle part being radially aligned with respect to a shaft of the mixing and conveying device, each of said paddles having an outer paddle part projecting perpendicularly from the inner paddle part in rotational sense, and the inner paddle part including recesses and deflection plates.

15. A developer station according to claim 14, wherein the deflection plates project from the inner paddle part at an acute angle.

16. A developer station according to claim 14, wherein the deflection plates provided at each of said paddles are aligned parallel to one another.

17. A developer station according to claim 14, wherein the deflection plates projecting from two neighboring paddles point in opposite directions so that the developer is conveyed in opposite directions by two neighboring paddles of the mixing and conveying means.

18. A developer station according to claim 14, wherein the inner paddle part of each paddle has a projection proceeding parallel to the inner paddle part in radial direction outside the outer paddle part.

19. A developer station according to claim 14, further comprising:

developer repellers in a region of both ends of the shaft of the mixing and conveying means.

* * * * *